US010362815B2

(12) United States Patent
Thompson

(10) Patent No.: US 10,362,815 B2
(45) Date of Patent: Jul. 30, 2019

(54) ANTI-GRIP KIMONO

(71) Applicant: Lime Enterprises International Limited, Hong Kong (CN)

(72) Inventor: Dean Thompson, Hong Kong (CN)

(73) Assignee: Lime Enterprises Limited, Kowloon (HK)

( * ) Notice: Subject to any disclaimer, the term of this patent is extended or adjusted under 35 U.S.C. 154(b) by 187 days.

(21) Appl. No.: 14/549,964

(22) Filed: Nov. 21, 2014

(65) Prior Publication Data

US 2016/0143374 A1 May 26, 2016

(51) Int. Cl.
*A41D 13/00* (2006.01)
*A41D 31/00* (2019.01)
*A41D 1/08* (2018.01)

(52) U.S. Cl.
CPC ..... *A41D 13/0015* (2013.01); *A41D 31/00* (2013.01); *A41D 1/08* (2013.01)

(58) Field of Classification Search
CPC ..... A41D 13/0015; A41D 29/00
See application file for complete search history.

(56) References Cited

U.S. PATENT DOCUMENTS 1,143,282 A * 6/1915 King ..... A41D 10/00 2/227
1,489,784 A * 4/1924 O'Shea ..... A41D 1/04 2/113
2,154,684 A * 4/1939 Kool ..... A41F 5/00 2/117
4,222,124 A * 9/1980 Hiranishi ..... A41D 1/00 2/93
4,389,733 A 6/1983 Boykins, Jr.
5,105,478 A * 4/1992 Pyc ..... A41D 27/28 2/106
5,426,787 A 6/1995 Freeman
5,530,966 A 7/1996 West
5,845,336 A * 12/1998 Golde ..... A41D 27/28 2/93
6,139,328 A 10/2000 Picotte
6,353,932 B2 * 3/2002 Stembridge ..... A41D 13/0015 2/69
6,353,943 B1 3/2002 Stevens
8,281,414 B2 10/2012 Mickle
8,418,262 B2 * 4/2013 Angus ..... A41D 1/04 2/2.5
2003/0167551 A1 * 9/2003 Findlay ..... A41D 3/02 2/93
2006/0143777 A1 * 7/2006 Dennis ..... A41D 13/1209 2/114
2006/0212988 A1 * 9/2006 West ..... A41D 13/015 2/108
2006/0282933 A1 12/2006 Chambliss et al.
2010/0175168 A1 * 7/2010 Yari ..... A41D 1/06 2/244

(Continued)

*Primary Examiner* — Anna K Kinsaul
(74) *Attorney, Agent, or Firm* — Law Firm of Stuart S. Levy; Stuart S. Levy

(57) ABSTRACT

Provided herein is a kimono jacket that has three or more anti-grip reinforcement panels, wherein the anti-grip reinforcement panels are capable of popping and/or releasing a grip of an opponent when the reinforced kimono is gripped. Also provided herein is a kit including a kimono that has anti-grip reinforcement panels and kimono pants.

10 Claims, 9 Drawing Sheets

(56) References Cited

U.S. PATENT DOCUMENTS

| | | | | |
|---|---|---|---|---|
| 2012/0005797 | A1* | 1/2012 | Cotsoglou | A41D 13/05 2/16 |
| 2012/0023641 | A1* | 2/2012 | Shen | A41H 27/00 2/122 |
| 2012/0311759 | A1* | 12/2012 | Moore | A41D 27/02 2/69 |
| 2012/0324618 | A1 | 12/2012 | Dieffenbacher | |
| 2013/0061377 | A1 | 3/2013 | Wyner et al. | |
| 2013/0086728 | A1* | 4/2013 | Ryu | A41D 13/0015 2/70 |
| 2013/0130870 | A1 | 5/2013 | McCranor | |

* cited by examiner

ANTI-GRIP KIMONO

FIELD OF THE INVENTION

The present invention relates generally to the field of garments such as kimonos worn by individuals for martial arts such as in the practice of mixed martial arts, jiu jitsu, judo, tae kwon do, and/or karate.

BACKGROUND OF THE DISCLOSURE

It is desirable for individuals who practice martial arts to wear specialized clothing, garments, uniforms and/or gear designed for an enhanced martial arts experience. Such clothing is traditionally referred to as a kimono or gi, such as for example a Brazilian jiu jitsu gi.

It is commonly understood that the kimono, a Japanese traditional garment, has been adapted for the practice of martial arts to fit the martial artisan in such a manner so as to impart the ability to execute full range motion and/or movements. The gi, commonly used in Brazilian jiu jitsu has been adapted from the kimono. A cloth belt is worn over the gi, both to keep the jacket of the kimono closed, and as symbol of the skill level or rank of the practitioner. The gi, constructed of heavy or light-weight cotton or cotton blends, is typically offered in a set of a jacket and reinforced trousers, and the material, particularly of the jacket, is therefore often accessible and easy to grip by an opponent during training, practice or competition.

While kimonos such as the gi are readily available and may be found, for example in U.S. Pat. Nos. 4,389,733; 5,426,787; and 6,353,932; and United States Application Number 2006/0282933; none of these references disclose the embodiments of the kimono disclosed herein.

Therefore, there is a need in the field for improving the kimono or gi so that the material/fabric, particularly of the outer surfaces of the kimono jacket, is resistant to a grip by an opponent in the practice of martial arts such as, without limitation, mixed martial arts, jiu jitsu, judo, tae kwon do, or karate.

All documents and references cited herein and in the referenced patent documents, are hereby incorporated herein by reference.

SUMMARY OF THE INVENTION

The present inventor has constructed an innovative kimono or gi with anti-grip reinforcement panels in such a manner so as to impart the kimono wearer with an anti-grip experience (i.e., pertaining to the grip of an opponent) when grappling, practicing and/or competing in martial arts such as in the practice of mixed martial arts, jiu jitsu, judo, tae kwon do, and/or karate.

Disclosed herein is a kimono jacket comprising three or more anti-grip reinforcement panels, wherein the anti-grip reinforcement panels are capable of popping and/or releasing a grip of an opponent when the reinforced kimono is gripped by the opponent.

In another embodiment, the reinforcement panels of the kimono jacket are interior reinforcement panels, exterior reinforcement panels, or combination thereof.

In another embodiment, the reinforcement panels are selected from the group consisting of sleeve reinforcement panels, chest reinforcement panels, back reinforcement panels, torso reinforcement panels, bottom edge reinforcement panels, side reinforcement panels, and a combination thereof.

Disclosed herein are kimono pants comprising one or more anti-grip reinforcement panels, wherein the one or more anti-grip reinforcement panels are capable of popping and/or releasing a grip of an opponent when the reinforced kimono is gripped by the opponent.

Also disclosed herein is a kit comprising a kimono jacket and pants, wherein the kimono jacket comprises three or more anti-grip reinforcement panels, wherein the anti-grip reinforcement panels are capable of popping and/or releasing a grip of an opponent when the reinforced kimono is gripped by the opponent.

In another embodiment, the kimono pants comprise one or more anti-grip reinforcement panels.

In another embodiment, the reinforcement panels of the kimono pants are interior reinforcement panels, exterior reinforcement panels, or combination thereof.

In another embodiment, the one or more anti-grip reinforcement panels of the kimono pants are selected from the group consisting of knee reinforcement panels, abdomen reinforcement panels, lower back reinforcement panels, quadriceps reinforcement panels, bottom cuff reinforcement panels, gluteus reinforcement panels, hip reinforcement panels, and a combination thereof.

In other embodiments, such kits may additionally include other related martial arts-related gear.

In other embodiments, the kimono jacket and/or kimono pants in the preceding paragraphs may additionally incorporate any of the preceding or subsequently disclosed embodiments.

The Summary of the Invention is not intended to define the claims nor is it intended to limit the scope of the invention in any manner.

Other features and advantages of the invention will be apparent from the following Drawings, Detailed Description, and the Claims.

BRIEF DESCRIPTION OF THE FIGURES

FIG. 1A shows interior anti-grip reinforcement panels on the inner surface of the kimono jacket and FIG. 1B shows interior anti-grip reinforcement panels from a perspective view of the outer surface of the kimono jacket.

FIG. 2A shows interior anti-grip reinforcement panels on the inner surface of the kimono jacket and FIG. 2B shows interior anti-grip reinforcement panels from a perspective view of the outer surface of the kimono jacket.

FIG. 3A shows interior anti-grip reinforcement panels on the inner surface of the kimono jacket and FIG. 3B shows interior anti-grip reinforcement panels from a perspective view of the outer surface of the kimono jacket.

FIG. 4A shows interior anti-grip reinforcement panels on the inner surface of the kimono jacket and FIG. 4B shows interior anti-grip reinforcement panels from a perspective view of the outer surface of the kimono jacket.

FIG. 5A shows a front perspective view of exterior anti-grip reinforcement panels on the outer surface of the kimono jacket and FIG. 5B shows a back perspective view of exterior anti-grip reinforcement panels on the outer surface of the kimono jacket.

FIG. 6A shows a front perspective view of interior anti-grip reinforcement panels on the inner surface of the pants. FIG. 6B shows a back perspective view of interior anti-grip reinforcement panels on the inner surface of the pants. FIG. 6C shows a front perspective view of exterior anti-grip reinforcement panels on the outer surface of the pants. FIG. 6D shows a back perspective view of exterior anti-grip reinforcement panels on the outer surface of the pants.

FIG. 7A shows a front perspective view of exterior anti-grip reinforcement panels oriented in an ornamental pattern on the outer surface of the pants. FIG. 7B shows a back perspective view of exterior anti-grip reinforcement panels oriented in an ornamental pattern on the outer surface of the pants.

DETAILED DESCRIPTION

Figure 1A:
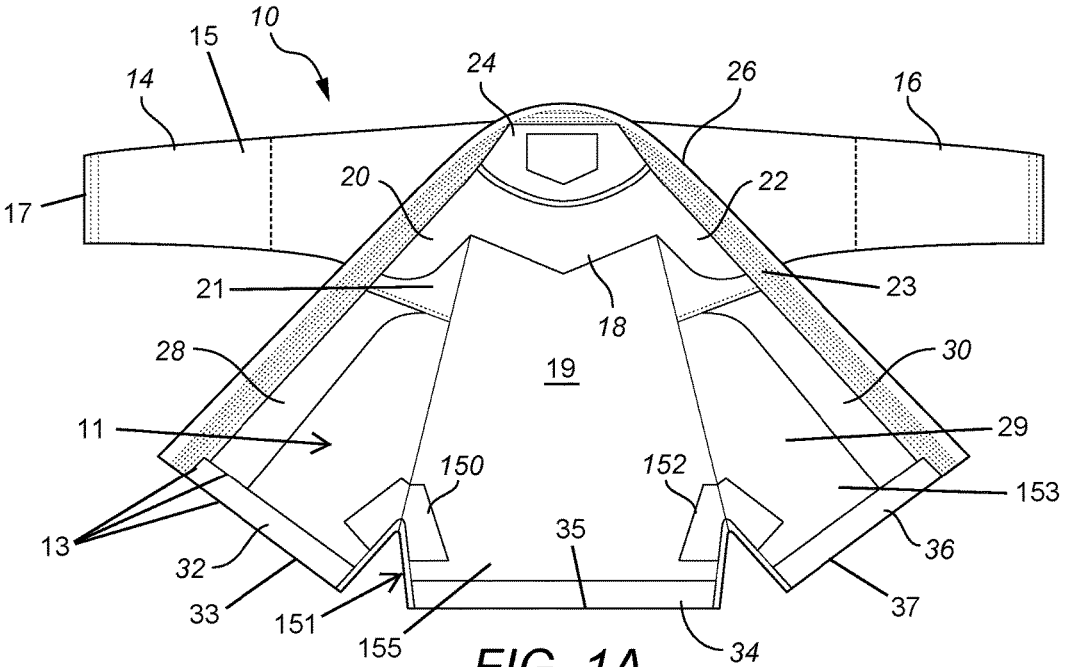
FIG. 1A-1B illustrates perspective views of an embodiment of a kimono jacket disclosed herein.

The present invention is illustrated in the drawings and description in which like elements are assigned the same reference numerals. However, while particular embodiments are illustrated in the drawings, there is no intention to limit the present invention to the specific embodiment or embodiments disclosed. Rather, the present invention is intended to cover all modifications, alternative constructions, and equivalents falling within the spirit and scope of the invention. As such, the drawings are intended to be illustrative and not restrictive.

Unless otherwise defined, all technical terms used herein have the same meaning as commonly understood by one of ordinary skill in the art to which this technology belongs.

Exemplary embodiments of the present invention are depicted in FIGS. 1-7.

The kimono disclosed herein provides an innovative advantage to the martial artisan. The kimono or gi is constructed with anti-grip reinforcement panels in such a manner so as to impart to the martial artisan an anti-grip experience (by an opponent) when grappling, practicing and/or competing in martial arts such as in, without limitation, mixed martial arts, jiu jitsu, judo, tae kwon do, and/or karate. While holding to the traditions of the kimono's loose fit, the kimono disclosed herein will uniquely provide the martial artisan with an experience more closely resembling a "no-gi" form of marital arts which emphasizes the body control of the artisan's torso and head (and which typically requires the martial artisan to wear tight fitting clothing such as rash guards and/or compression shorts).

For the purposes of the invention, the terminology "martial arts" encompasses any and all martial arts-related disciplines which require the practicing martial artisan to wear a kimono (kimono jacket and/or kimono pants). Such martial arts-related disciplines include, without limitation, mixed martial arts, jiu jitsu, judo, tae kwon do, and/or karate. Such martial arts-related disciplines involve, without limitation, grappling, striking, fighting, wrestling, infighting, and/or a combination thereof.

For the purposes of the invention, the terminology "kimono" is known in the art to describe the whole outfit, or occasionally just the jacket.

For the purposes of the invention, the terminology "kimono jacket" and/or "kimono jackets" means and/or can be used interchangeably with the terminology "kimono" and/or "kimonos" and/or "gi" and/or "gis" and/or "jacket" and/or "jackets."

For the purposes of the invention, the terminology "kimono pants" means and/or can be used interchangeably with the terminology "kimono" and/or "kimonos" and/or "pair of kimono pants" and/or "pair of pants" and/or "gi pants" and/or "pants" and/or "kimono trousers" and/or "trousers."

For the purposes of the invention, the terminology "anti-grip reinforcement panel" means or can be used interchangeably with the terminology "anti-grip reinforcement panels" or "anti-grip panel" or "anti-grip panels" or "reinforcement panel" or "reinforcement panels" or "panel" or "panels." Such anti-grip reinforcement panels are comprised of materials readily available and known in the art. Such materials include, without limitation, 100% cotton, cotton blends such as, for example CVC (Chief Value Cotton) fabric of about 55-80% cotton and 20-45% polyester blend, canvas, Lycra® or spandex of about 10% or up to 90% polyester, rubber, polytetrafluoroethylene (i.e. the material or compound commonly referred to by the trade name Teflon®), and/or combinations thereof. Such reinforcement panels can be varied according to size and placement so long as the kimono provides the martial artisan with the advantage and/or experience of an opponents' grip popping off of or releasing away from the reinforced outer surfaces (where there is an underlying (interior) or overlying (exterior) reinforcement panel) of the kimono when the reinforced kimono is grasped or grabbed or gripped. In certain embodiments, placement of the anti-grip reinforcement panels is in non-trim or non-edging regions of the kimono. For example, such non-trim or non-edging regions of the kimono would include any and all regions of the kimono except trim or edging regions of the kimono. With respect to the exterior anti-grip reinforcement panels, and without wishing to be bound by theory, such an anti-grip experience is a consequence of the sliding action of the double layers of fabric material created by the reinforcement panels overlying the material of the kimono (thereby creating a flux of increased/decreased friction between the layers) in the reinforced areas of the kimono when the reinforced kimono is gripped. With respect to the interior anti-grip reinforcement panels, and without wishing to be bound by theory, such an anti-grip experience is a consequence of the reduction in the outermost kimono fabric elasticity caused by the double layers of fabric material created by the reinforcement panels underlying the material of the kimono (thereby effecting a slippery or slick or release or "popping off" tactile sensation or action when an opponent attempts to maintain his/her grip of the outer surface of the reinforced kimono.)

Figure 1B:
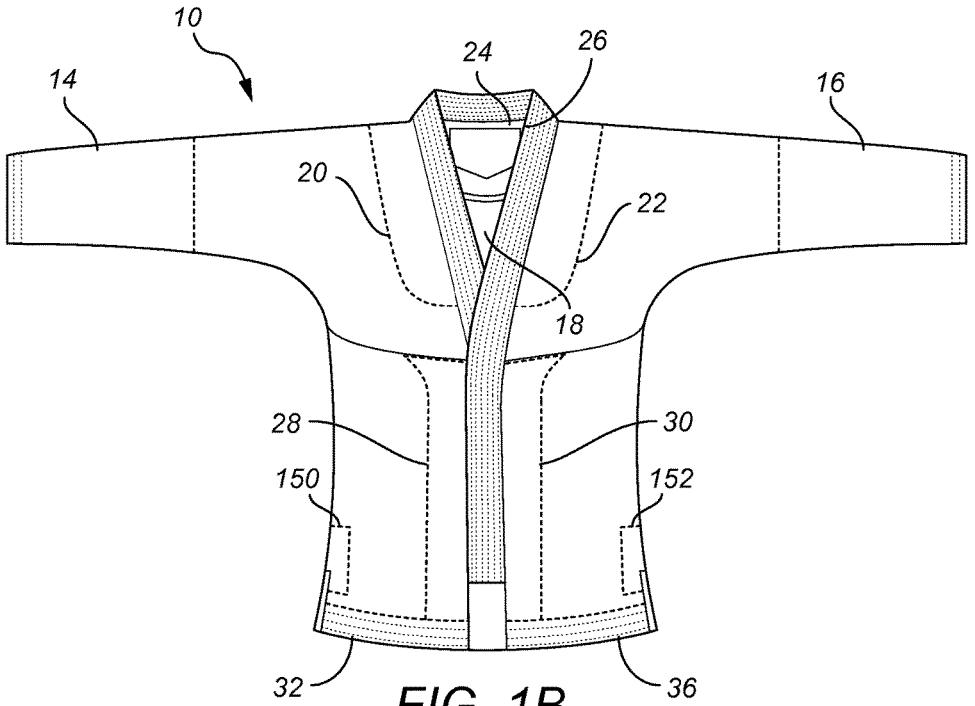

For the purposes of the present invention, the terminology "three or more" means "at least three or more than three." While the kimono disclosed herein is shown in FIGS. 1A-1B with an exemplary twelve anti-grip reinforcement panels, such a feature can be customized to accommodate any number of interior and/or exterior anti-grip reinforcement panels such as, for example, in FIGS. 2A-2B, 3A-3B, 4A-4B, and 5A-5B. Furthermore, such anti-grip reinforcement panels can be customized according to any sizing or placement variation of the reinforcement panel so long as the kimono provides the martial artisan with the advantage of an opponents' grip popping off of or releasing away from the outer surfaces of the reinforced kimono when it is gripped by the opponent. In some embodiments, the kimono disclosed herein comprises at least three anti-grip reinforcement panels. For example, such a kimono may have one interior anti-grip reinforcement panel on the inner surface each sleeve and one exterior anti-grip reinforcement panel on the back outer surface of the kimono just below the collar. In other embodiments, the kimono disclosed herein comprises four, five, six, seven, eight, nine, ten, eleven, twelve or more interior and/or exterior anti-grip reinforcement panels on the inner and/or outer surface of the kimono, particularly placed in locations of the kimono, such as sleeve, chest, torso, bottom edge, and/or side regions of the kimono, which would provide an anti-grip advantage and/or experience to the martial artisan wearing the kimono.

For the purposes of the present invention, the terminology "one or more" means "at least one or more than one." While the pair kimono pants disclosed herein is shown in FIGS. 6A-6D with an exemplary eight anti-grip reinforcement panels, such a feature can be customized to accommodate any number of interior and/or exterior anti-grip reinforcement panels such as, for example, 7A-7B. Furthermore, such anti-grip reinforcement panels can be customized according to any sizing or placement variation of the reinforcement panel so long as the kimono pants provide the martial artisan with the advantage of an opponents' grip popping off of or releasing away from the outer surfaces of the reinforced kimono pants when it is gripped by the opponent. In some embodiments, the kimono pants disclosed herein comprises at least one anti-grip reinforcement panel. For example, such a kimono may have one interior anti-grip reinforcement panel on the lower back inner surface of the kimono just below the waist band. In other embodiments, the kimono pants disclosed herein comprises two, three, four, five, six, seven, eight, nine, ten, eleven, twelve or more interior and/or exterior anti-grip reinforcement panels on the inner and/or outer surface of the kimono pants, particularly placed in locations of the kimono pants, such as the regions of the knees, hips, quads, bottom cuffs, abdomen, lower back, and/or gluteus, which would provide an anti-grip advantage and/or experience to the martial artisan wearing the kimono pants.

For the purposes of the present invention, the terminology "corresponds to" means that there is a compatible relationship between items which correspond to each other. For example, a kimono jacket has a corresponding pair of kimono pants which provide a similar or matching style, color(s), fabric material and/or weave. In other words, typically a martial artisan will desire a kimono jacket which has a corresponding pair of kimono trousers (or pants).

FIG. 1A shows a front perspective view of a 10 kimono jacket disclosed herein in an open position so that the 18, 20, 22, 28, 30, 32, 34, 36, 150, 152 interior anti-grip reinforcement panels are displayed. In this embodiment, the 10 kimono jacket comprises 14, 16, 18, 20, 22, 28, 30, 32, 34, 36, 150, 152 interior anti-grip reinforcement panels oriented or placed on an 11 inner surface of the 10 kimono. More particularly, as shown in FIG. 1A, the 18 interior anti-grip reinforcement panel can be positioned in a region of a 19 back of the 10 kimono jacket, the 20, 22 interior anti-grip reinforcement panels can be positioned in a region of a 21 chest of the 10 kimono jacket and adjacent to a 23 lapel of the 10 kimono jacket, the 28, 30 interior anti-grip reinforcement panels can be positioned in a region of a 29 torso of the 10 kimono jacket and adjacent to the 23 lapel of the 10 kimono jacket, the 14, 16 interior anti-grip reinforcement panels can be positioned in regions of sleeves 15 of the 10 kimono jacket and adjacent to 17 cuffs of the 10 kimono jacket, the 150, 152 interior anti-grip reinforcement panels can be positioned adjacent to 151 cutouts formed at a junction between 153 front and 155 rear sides of the 10 kimono jacket, and the 32, 34, 36 interior anti-grip reinforcement panels can be positioned along or adjacent to 33, 35, 37 bottom edges of the 153 front and 155 rear sides of the 10 kimono jacket. FIG. 1B shows a front perspective view of the 10 kimono jacket of FIG. 1A but in a closed position so that the 14, 16, 18, 20, 22, 28, 30, 32, 34, 36, 150, 152 interior anti-grip reinforcement panels are not visible on the outer surface of the 10 kimono. Such 14, 16, 18, 20, 22, 28, 30, 32, 34, 36, 150, 152 interior reinforcement panels are affixed to the inner surface of the 10 kimono through known techniques such as, without limitation, sewn seams, woven tape, fabric tape, fabric glue, and/or a combination thereof. It is appreciated that a shape of each of the 14, 16, 18, 20, 22, 28, 30, 32, 34, 36, 150, 152 interior anti-grip reinforcement panels of the 10 kimono jacket can be different from one another. Additionally, in some embodiments, each of the 14, 16, 18, 20, 22, 28, 30, 32, 34, 36, 150, 152 interior anti-grip reinforcement panels of the 10 kimono jacket can have one or more 13 substantially linear panel edges. More particularly, as shown, each of the 32, 34, 36 interior anti-grip reinforcement panels can be substantially rectangular-shaped having four 13 substantially linear panel edges. Additionally, or in the alternative, one or more of the 14, 16, 18, 20, 22, 28, 30, 32, 34, 36, 150, 152 interior anti-grip reinforcement panels of the 10 kimono jacket can be positioned in regions of the sleeves 15 of the 10 kimono jacket and adjacent to the 17 cuffs of the 10 kimono jacket.

FIGS. 1A-1B, 2A-2B, 3A-3B and 4A-4B additionally show the 24 tag area of the 10 kimono jacket as well as the 26 collar of the 10 kimono disclosed herein. In addition, the inside or outside anti-grip sleeve reinforcement panels 14 and 16 are located adjacent the cuff of each sleeve and are annular in shape when looking into the cuff at the end of each sleeve.

Figure 2A:
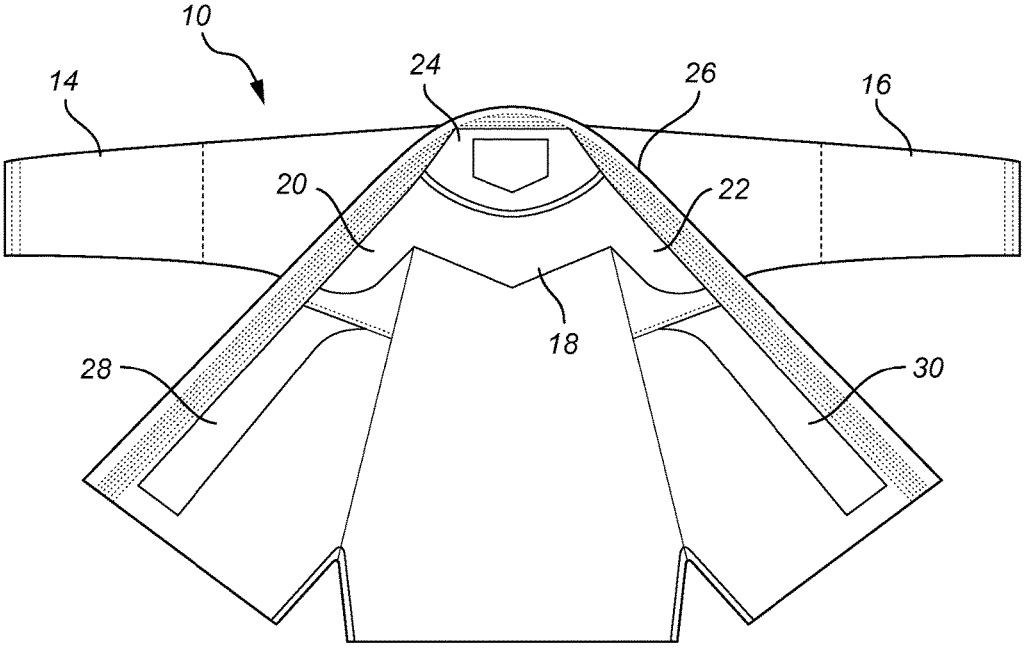
FIG. 2A-2B illustrates perspective views of an embodiment of a kimono jacket disclosed herein.

FIG. 2A shows a front perspective view of a 10 kimono jacket disclosed herein in an open position so that the 18, 20, 22, 28, 30 interior anti-grip reinforcement panels are displayed. In this embodiment, the 10 kimono jacket comprises 14, 16, 18, 20, 22, 28, 30 interior anti-grip reinforcement panels oriented or placed on the inner surface of the 10 kimono in regions of the 18 back, 20, 22 chest, 28, 30 torso, and 14, 16 sleeves of the 10 kimono jacket. FIG. 1B shows a front perspective view of the 10 kimono jacket of FIG. 2A but in a closed position so that the 14, 16, 18, 20, 22, 28, 30 interior anti-grip reinforcement panels are not visible on the outer surface of the 10 kimono.

Figure 3A:
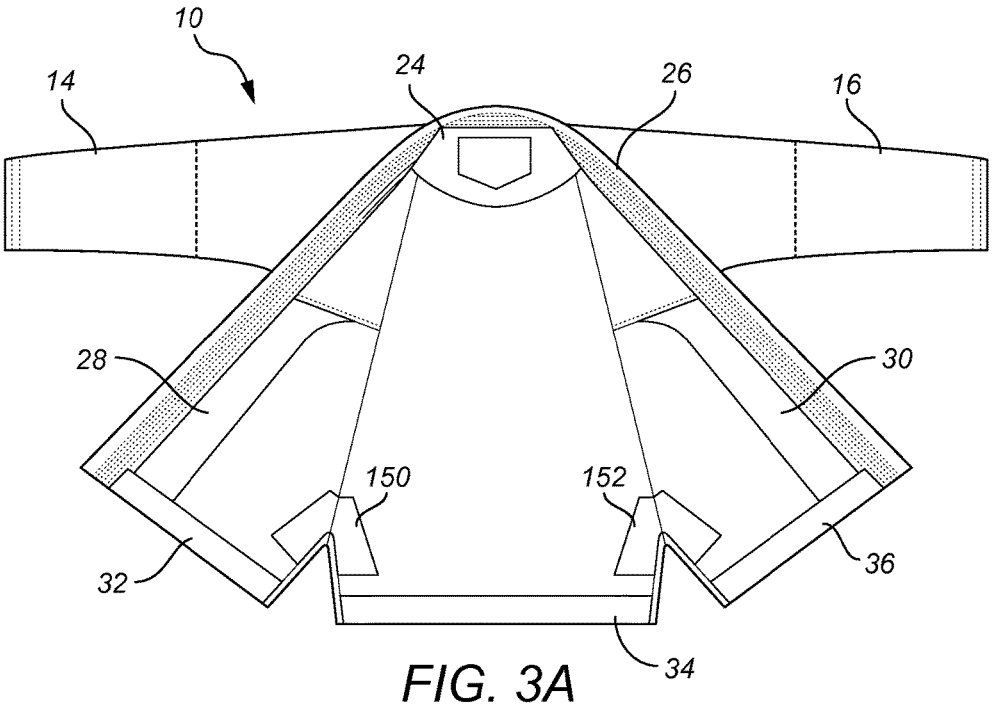
FIG. 3A-3B illustrates perspective views an embodiment of a kimono jacket disclosed herein.
Figure 3B:
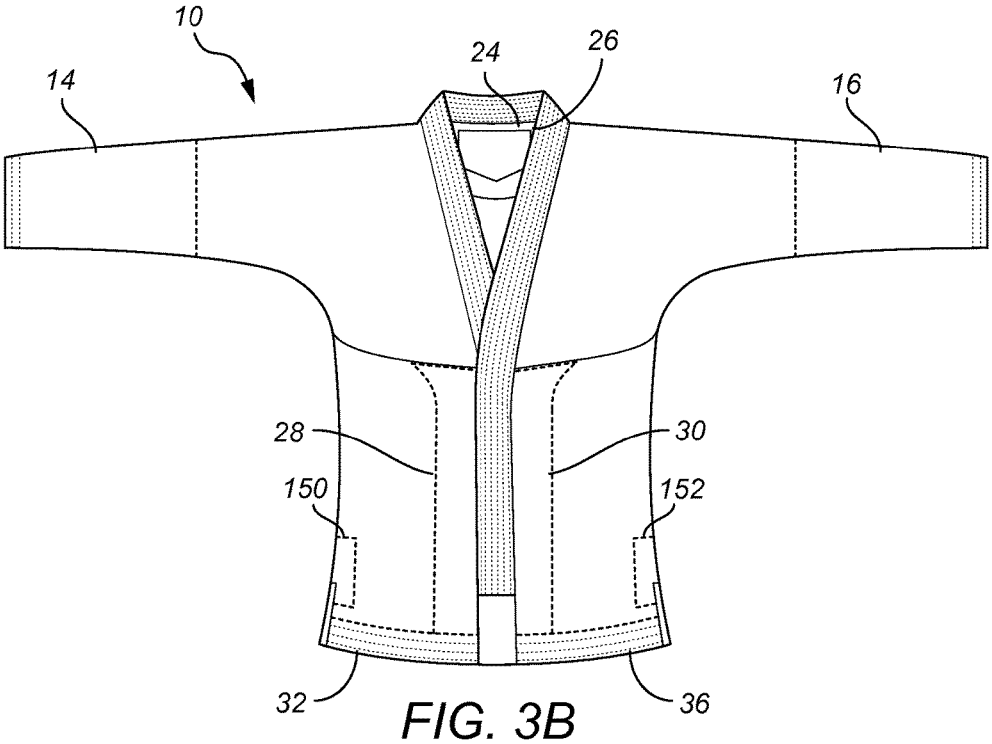

FIG. 3A shows a front perspective view of a 10 kimono jacket disclosed herein in an open position so that the 28, 30, 32, 34, 36, 150, 152 interior anti-grip reinforcement panels are displayed. In this embodiment, the 10 kimono jacket comprises 14, 16, 18, 28, 30, 32, 34, 36, 150, 152 interior anti-grip reinforcement panels oriented or placed on the inner surface of the 10 kimono in regions of the 28, 30 torso, 14, 16 sleeves, 150, 152 sides, and 32, 34, 36 bottom edges of the 10 kimono jacket. FIG. 3B shows a front perspective view of the 10 kimono jacket of FIG. 3A but in a closed position so that the 14, 16, 28, 30, 32, 34, 36, 150, 152 interior anti-grip reinforcement panels are not visible on the outer surface of the 10 kimono.

Figure 4A:
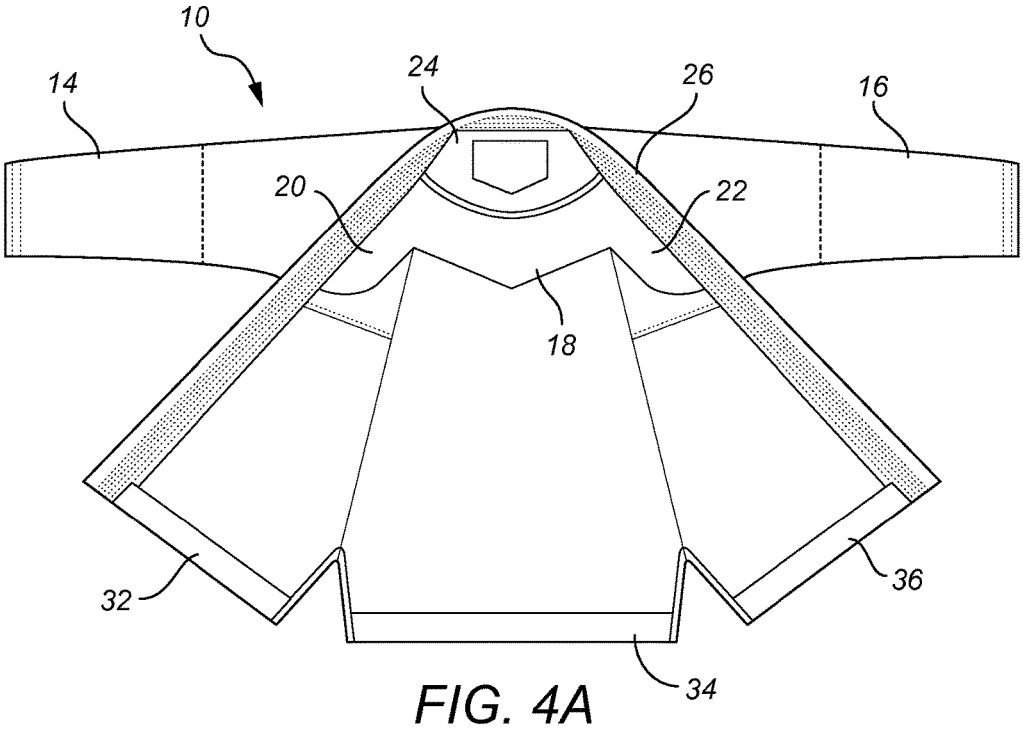
FIG. 4A-4B illustrates perspective views of an embodiment of a kimono jacket disclosed herein.
Figure 4B:
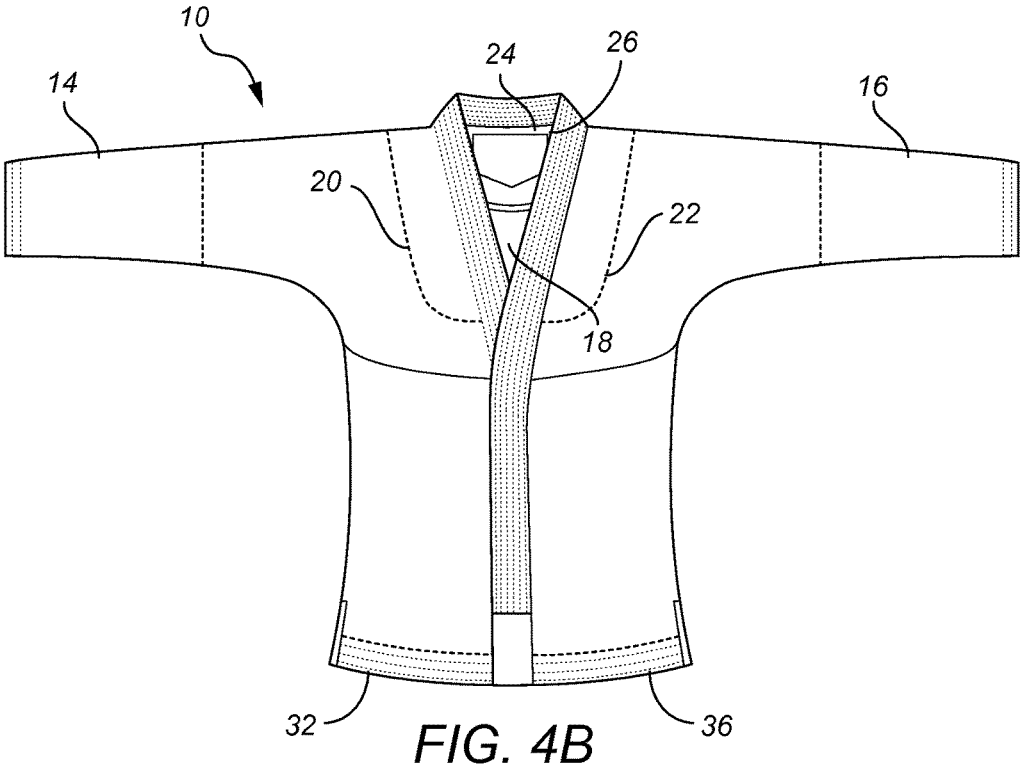

FIG. 4A shows a front perspective view of a 10 kimono jacket disclosed herein in an open position so that the 18, 20, 22, 32, 34, 36 interior anti-grip reinforcement panels are displayed. In this embodiment, the 10 kimono jacket comprises 14, 16, 18, 20, 22, 32, 34, 36 interior anti-grip reinforcement panels oriented or placed on the inner surface of the 10 kimono in regions of the 18 back, 20, 22 chest, 14, 16 sleeves, and 32, 34, 36 bottom edges of the 10 kimono jacket. FIG. 4B shows a front perspective view of the 10 kimono jacket of FIG. 4A but in a closed position so that the 14, 16, 18, 20, 22, 32, 34, 36 interior anti-grip reinforcement panels are not visible on the outer surface of the 10 kimono.

Figure 5A:
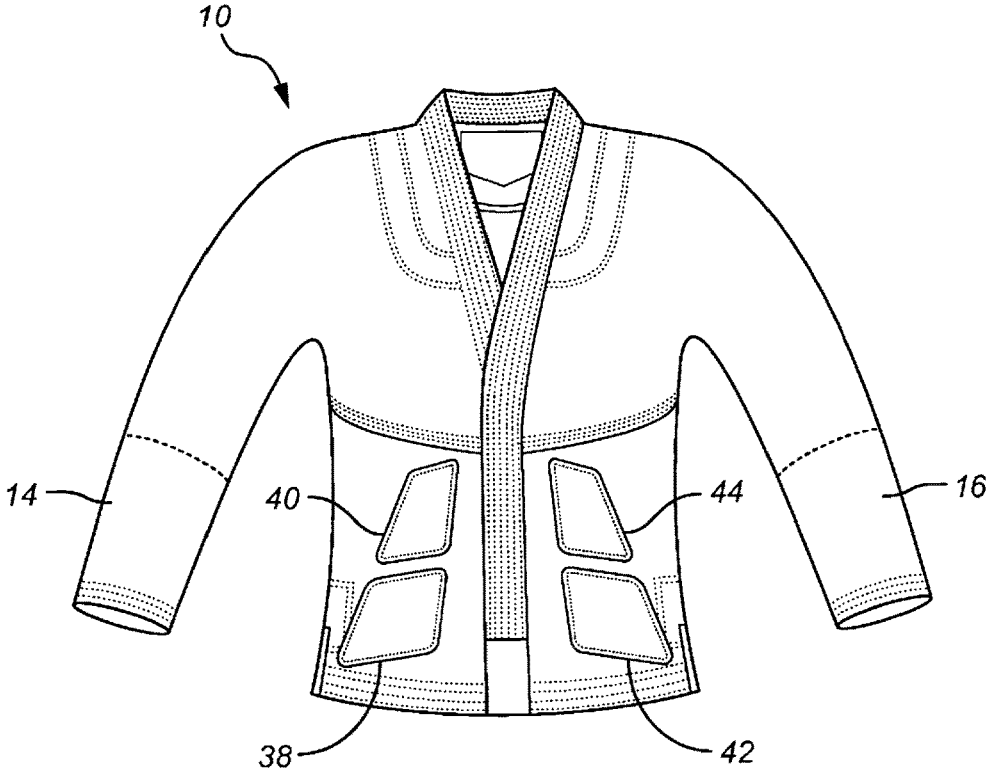
FIG. 5A-5B illustrates perspective views of an embodiment of a kimono jacket disclosed herein.
Figure 5B:
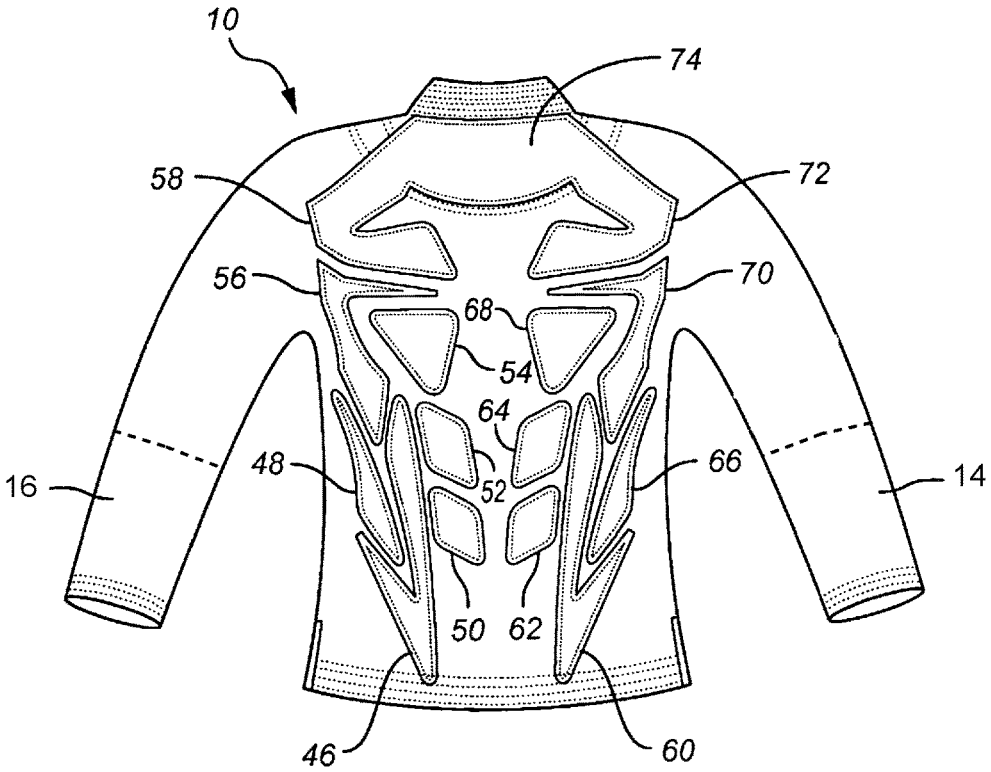

FIG. 5A shows a front perspective view of a 10 kimono jacket disclosed herein in a closed position so that the 38, 40, 42, 44 exterior anti-grip reinforcement panels are displayed. In this embodiment, the 10 kimono jacket comprises 14, 16 interior anti-grip reinforcement panels oriented or placed on the inner surface of the 10 kimono in the region of the 14, 16 sleeves of the 10 kimono jacket and 38, 40, 42, 44 exterior anti-grip reinforcement panels oriented or placed on the outer surface of the 10 kimono in the region of the 38, 40, 42, 44 torso of the 10 kimono jacket. FIG. 5B shows a back perspective view of the 10 kimono jacket of FIG. 5A comprises 14, 16 interior anti-grip reinforcement panels oriented or placed on the inner surface of the 10 kimono in the region of the 14, 16 sleeves of the 10 kimono jacket and 46, 48, 50, 52, 54, 56, 58, 60, 62, 64, 66, 68, 70, 72, 74 exterior anti-grip reinforcement panels oriented or placed on the outer surface of the 10 kimono in the region of the 46, 48, 50, 52, 54, 56, 58, 60, 62, 64, 66, 68, 70, 72, 74 back of the 10 kimono jacket. Such 14, 16, interior and 46, 48, 50, 52, 54, 56, 58, 60, 62, 64, 66, 68, 70, 72, 74 exterior reinforcement panels are affixed to the inner and outer surface of the 10 kimono through known techniques such as, without limitation, sewn seams, woven tape, fabric tape, fabric glue, and/or a combination thereof. It is appreciated that a shape of each of the 14, 16, interior and 46, 48, 50, 52, 54, 56, 58, 60, 62, 64, 66, 68, 70, 72, 74 exterior reinforcement panels of the 10 kimono jacket can be different from one another. Additionally, in some embodiments, each of the 14, 16, interior and 46, 48, 50, 52, 54, 56, 58, 60, 62, 64, 66, 68, 70, 72, 74 exterior reinforcement panels of the 10 kimono jacket can have one or more substantially linear panel edges.

Figure 6A:
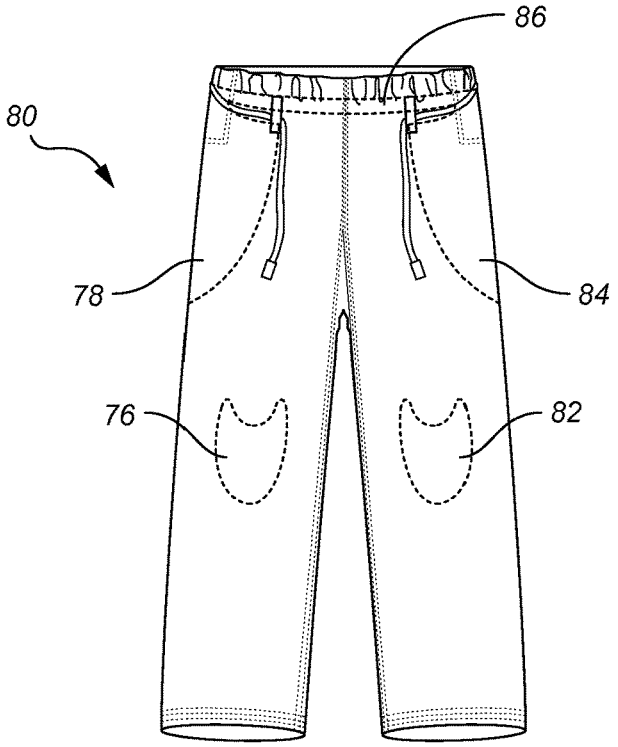
FIG. 6A-D illustrates perspective views of an embodiment of a pair of kimono pants disclosed herein.
Figure 6B:
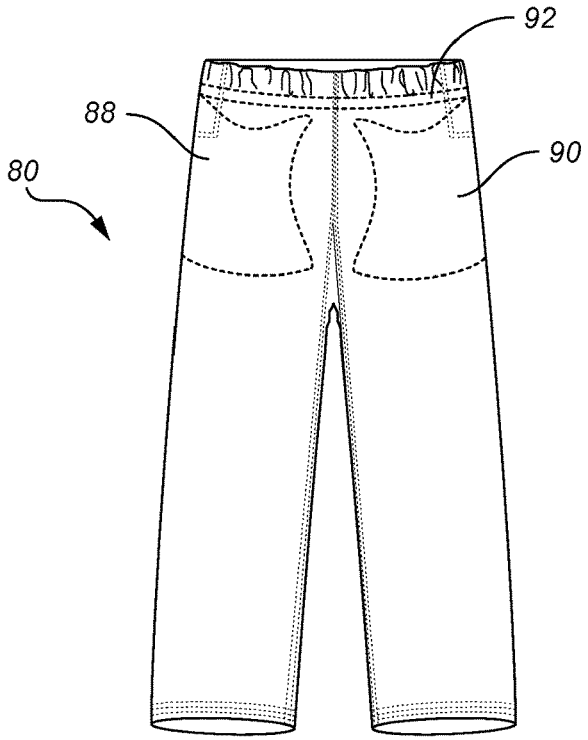
Figure 6C:
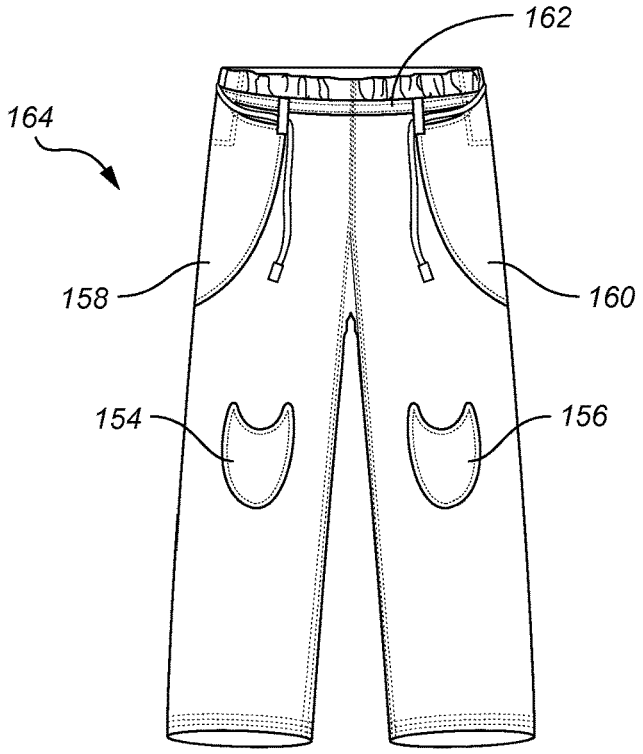
Figure 6D:
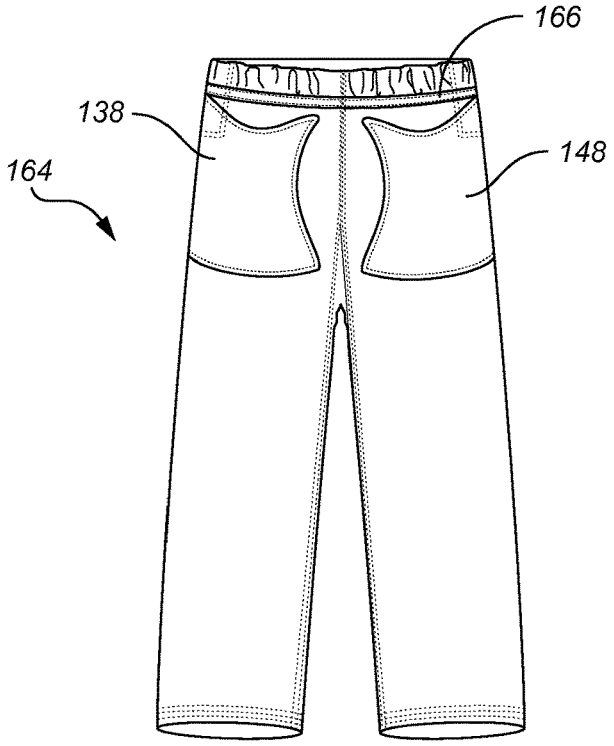

FIG. 6A shows a front perspective view of a pair of 80 kimono pants disclosed herein comprising 76, 78, 82, 84, 86 interior anti-grip reinforcement panels oriented or placed on the inner surface of the 80 kimono pants in regions of the 76, 82 knee, 86 abdomen, and 78, 84 hip. FIG. 6B shows a back perspective view of the 80 kimono pants of FIG. 6A comprising 88, 90, 92 interior anti-grip reinforcement panels oriented or placed on the inner surface of the 80 kimono pants in regions of the 92 lower back and 88, 90 gluteus. FIG. 6C shows a front perspective view of a pair of 164 kimono pants disclosed herein comprising 154, 156, 158, 160, 162 exterior anti-grip reinforcement panels oriented or placed on the outer surface of the 164 kimono pants in the regions of the 154, 156 knee, 162 abdomen, and 158, 160 hip. FIG. 6D shows a back perspective view of the 164 kimono pants of FIG. 6C comprising 138, 148, 166 exterior anti-grip reinforcement panels oriented or placed on the outer surface of the 164 kimono pants in the regions of the 166 lower back and 138, 148 gluteus. It is appreciated that a shape of each of the 88, 90, 92 interior anti-grip reinforcement panels, and each of the 154, 156, 158, 160, 162 exterior anti-grip reinforcement panels of the 80 kimono pants shown in FIG. 6A-6D can be different from one another. Additionally, in some embodiments, each of the 88, 90, 92 interior anti-grip reinforcement panels, and each of the 154, 156, 158, 160, 162 exterior anti-grip reinforcement panels of the 80 kimono pants can have one or more substantially linear panel edges.

Figure 7A:
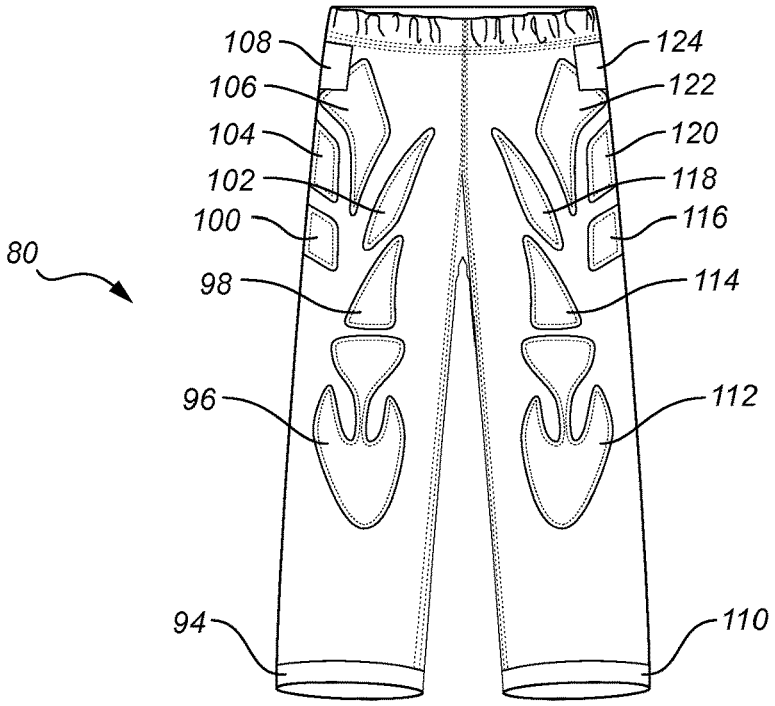
FIG. 7A-B illustrates perspective views of an embodiment of a pair of kimono pants disclosed herein.
Figure 7B:
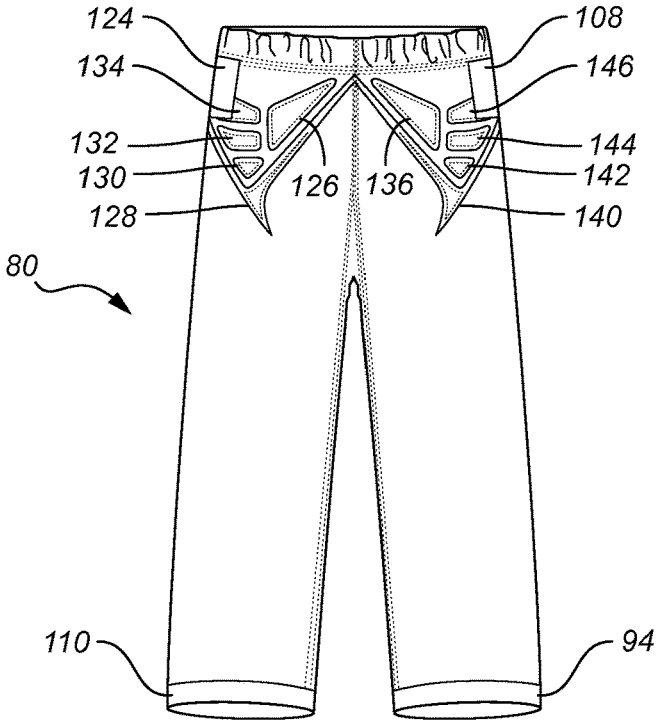

FIG. 7A shows front perspective view of a pair of 80 kimono pants disclosed herein comprising 94, 96, 98, 100, 102, 104, 106, 108, 110, 112, 114, 116, 118, 120, 122, 124 exterior anti-grip reinforcement panels oriented or placed on the outer surface of the 80 kimono pants in regions of the 96, 112 knee, 98, 100, 102, 114, 116, 118 quadriceps, 104, 106, 108, 120, 122, 124 hip, and 94, 110 bottom cuff. FIG. 7B shows a back perspective view of the 80 kimono pants of FIG. 7A comprising 94, 108, 110, 124, 126, 128, 130, 132, 134, 136, 140, 142, 144, 146 exterior reinforcement panels oriented or placed on the outer surface of the 80 kimono pants in regions of the 108, 124 hip, 126, 128, 130, 132, 134, 136, 140, 142, 144, 146 gluteus and 94, 110 bottom cuff. It is appreciated that a shape of each of the 94, 96, 98, 100, 102, 104, 106, 108, 110, 112, 114, 116, 118, 120, 122, 124 exterior anti-grip reinforcement panels of the 80 kimono pants shown in FIG. 7A-7B be different from one another. Additionally, in some embodiments, each of the 94, 96, 98, 100, 102, 104, 106, 108, 110, 112, 114, 116, 118, 120, 122, 124 exterior anti-grip reinforcement panels of the 80 kimono pants can have one or more substantially linear panel edges. Additionally, or in the alternative, one or more of the 94, 96, 98, 100, 102, 104, 106, 108, 110, 112, 114, 116, 118, 120, 122, 124 exterior anti-grip reinforcement panels of the 80 kimono pants can be positioned in the region of and adjacent to the bottom cuff.

The 10 kimono jacket disclosed herein may be provided as a kit. Such kits comprise the 10 kimono jacket and 80, 164 kimono pants and/or other gear pertaining to the self-defense martial arts field such as, without limitation, a belt, patches, additional anti-grip reinforcement panels and/or a combination thereof.

The 10 kimono jacket, 80, 164 kimono pants, and kits disclosed herein may be manufactured and/or constructed in any size or color variation and/or can be scaled up or down in accordance with the customizability of the product to the martial artisan's needs and/or preferences.

The 10 kimono jacket, 80, 164 kimono pants, and kits comprising the same and disclosed herein may be customized on inner and/or outer surface(s) to include logos, graphics, designs, and/or text such as, without limitation, logos, graphics, designs, text and/or combinations thereof relating to and/or inspired by the martial arts, or relating to Marvel Comics characters or superheroes, or other brands such as, without limitation the brand names, Storm Kimonos® and/or Zero Hold Technology®, particularly for placement in and/or adornment of the 24 tag region of the 10 kimono jacket and/or 80, 164 pants. The 10 kimono jacket, 80, 164 kimono pants, and kits comprising the same and disclosed herein may be customized on inner and/or outer surface(s) to include any desired logo, graphic, design and/or text whether already known or newly created.

The 10 kimono jacket, 80, 164 kimono pants, and kits disclosed herein is made of materials and/or fabrics and/or fabric weaves and/or Japanese cotton weaves well known and readily available. Materials and fabrics may range from a wide variety of available materials and fabrics such as, without limitation, cotton, canvas, polyester, Lycra®, spandex, ballistic nylon, nylon, elastic, elastane fiber, rubber, Teflon®, and/or combinations thereof.

The 10 kimono jacket, 80, 164 kimono pants, and kits of the present invention may incorporate reasonable design parameters, features, modifications, advantages, and variations that are readily apparent to those skilled in the art to which this technology pertains.

Figure 2B:
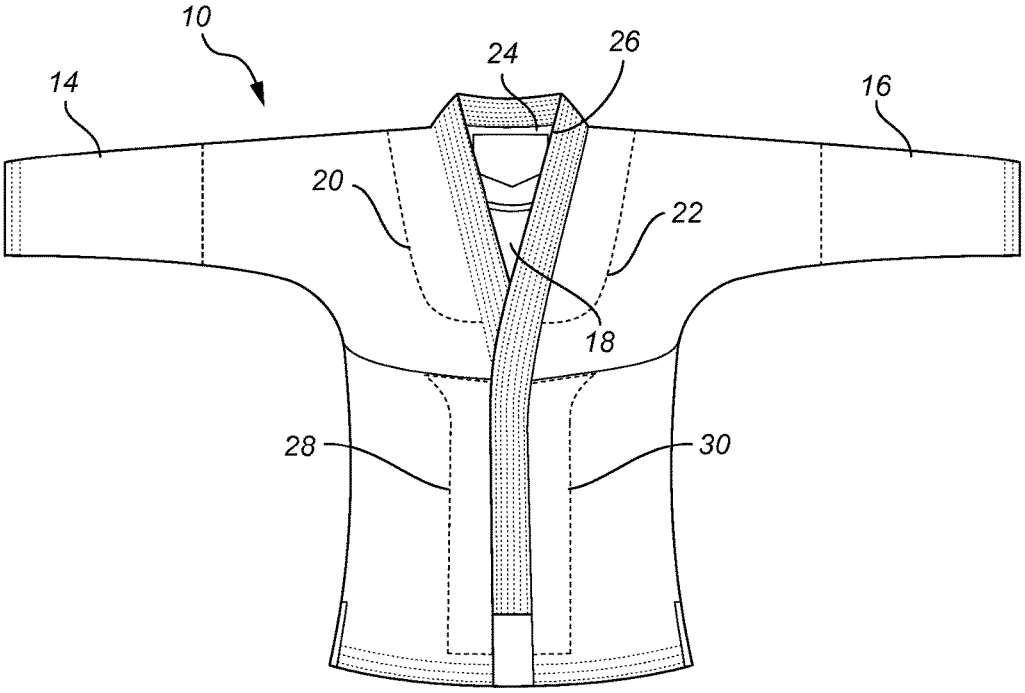
Figure 7C:
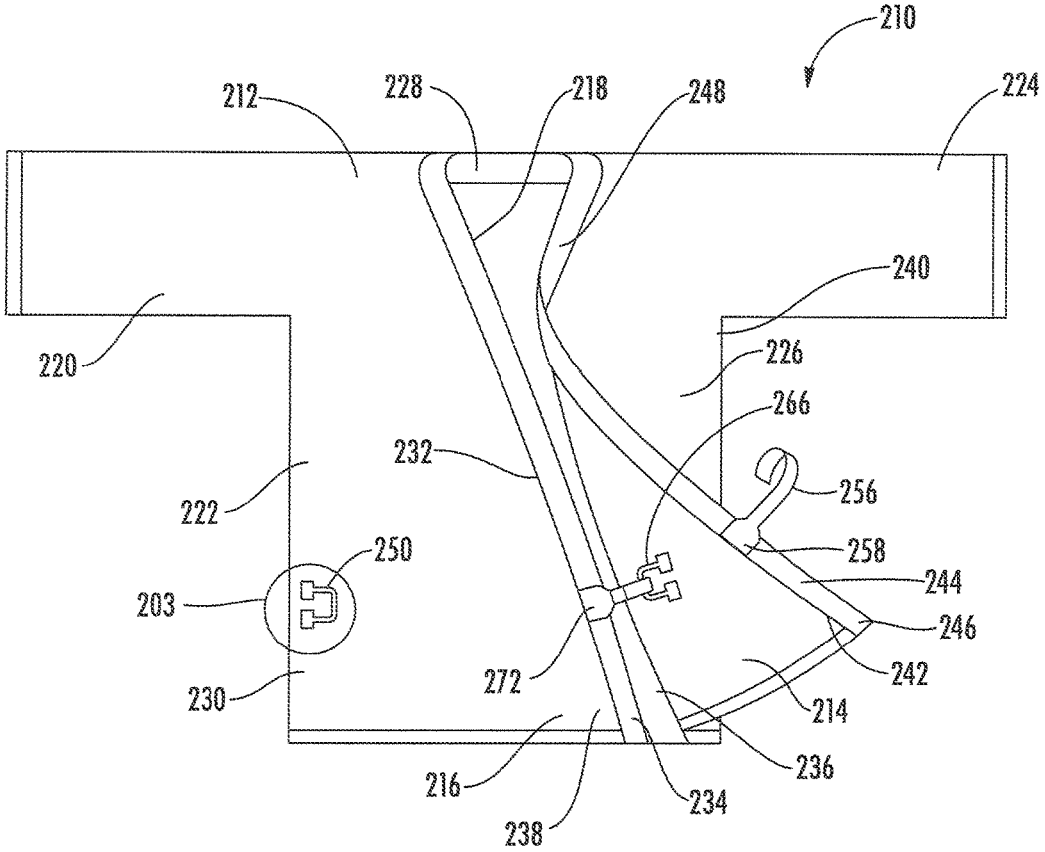
FIG. 7C PRIOR ART
FIG. 7C represents an illustration of a prior art martial arts kimono of U.S. Pat. No. 5,426,787 which is incorporated by reference in paragraphs [0004] and [0006] of the specification as fixed.

As shown in FIG. 7C, a known martial arts kimono jacket 210 contains an upper uniform component 212 having an inner surface 214, an outer surface 216, a back portion 218, a right sleeve portion 220, a right body portion 222, a left sleeve portion 224, a left body portion 226, and a collar portion 228. The right body portion 222 comprises the inner flap. The left body portion 226 comprises the outer flap. The right body portion 222 has a first edge 230 and a second edge 232. A right lapel 234 is secured to the second edge 232. The right lapel 234 has an inner surface 236 and an outer surface 238. The left body portion 226 has a first edge 240 and a second edge 242. A left lapel 244 is secured to the second edge 242 of the left body portion 226. The left lapel 244 has an inner surface 246 and an outer surface 248. Elements 250, 256, 258, 266, 272, and 203 refer to a connecting mechanism for connecting the left and right body portions of the prior art kimono referred to in paragraph [0004] of the specification as filed. As can be seen in FIG. 7C, collar 228 is contiguous with left and right lapels 248 and 234, respectively. In addition, as shown in FIG. 7C, the inner edge 232 of the right body portion extends inwardly toward the left body portion 226 and when worn further extends toward a left side of the wearer and the left lapel 248 extends over right lapel towards the right body portion and when worn further extends toward a right side of the wearer. As shown in FIGS. 2A and 2B, the collar and lapels are integrally formed and the lapels overlap and extend downwardly from the collar towards the bottom of the kimono jacket 10. Additionally, as shown in at least FIG. 2B, the collar 26 is shown extending upwardly from upper ends of each of the left and right sleeves.

Without departing from the scope and spirit of the present invention, reasonable features, modifications, advantages, and design variations of the claimed invention will become readily apparent to those skilled in the art by following the guidelines set forth in the preceding detailed description and embodiments.

What is claimed is:

1. A reinforced martial arts kimono containing anti-grip reinforced panels which pop-off or release from the grip of an opponent grabbing the reinforced martial arts kimono, the reinforced martial arts kimono comprising:

a kimono jacket that is formed from a first material;

the kimono jacket including right sleeve and right body portions;

the kimono further including left sleeve and left body portions and a collar;

the collar extending upwardly from upper ends of each of the left and right sleeves;

the right body portion includes an inner flap and the left body portion includes an outer flap;

each body portion includes a lapel which is contiguous with the collar;

the lapels extending downwardly from the collar toward the bottom of the kimono jacket;

wherein the lapel and inner flap of the right body portion extends under the lapel of the left body portion toward a left side of the wearer of the kimono jacket and the lapel and the outer flap of the left body portion extends over the inner flap of the right body portion and extends toward a right side of the wearer of the kimono jacket;

and the lapels and body portions are configured to be kept in place by a martial arts belt;

at least two anti-grip reinforcement panels affixed to an inside surface of the interior of the reinforced martial arts kimono;

the at least two reinforcement panels being located on the inside of the kimono form annular-shaped anti-grip reinforcement panels and the at least two reinforced panels are affixed to the inside of the sleeves of the reinforced anti-grip martial arts kimono jacket, adjacent to the cuffs of the each of the sleeves;

the at least two anti-grip reinforcement panels being of a second material which is different material than the first material forming the kimono jacket, the two reinforcement panels providing a sufficient popping-off tactile sensation or release of grip of an opponent grabbing the reinforced anti-grip martial arts kimono during the practice of martial arts;

and wherein the second material adjacent to the cuff of each of the left and right sleeves extends from the cuff upwardly toward the collar of the anti-grip martial arts kimono jacket.

2. The reinforced martial arts kimono of claim 1, further including several reinforced anti-grip reinforcement panels on outer surface of the back of the reinforced anti-grip martial arts kimono jacket.

3. The reinforced martial arts kimono of claim 1, wherein the kimono has an outer surface, and wherein a third anti-grip reinforcement panel is affixed to the outer surface of the kimono, wherein the kimono has both inner and outer anti-grip reinforcement panels.

4. The reinforced martial arts kimono of claim 1, wherein the reinforced anti-grip martial arts kimono includes kimono pants.

5. The reinforced martial arts kimono of claim 1, wherein the first material is 100% cotton, and the second material is a cotton-polyester blend.

6. The reinforced martial arts kimono of claim 1, wherein the first material is selected from the group of 100% cotton, cotton-polyester blend, ballistic nylon and canvas; and wherein the second material is selected from the group of 100% cotton, cotton-polyester blend and canvas.

7. The reinforced martial arts kimono of claim 1, wherein the kimono jacket includes a cutout, a bottom edge, a front side and a rear side wherein the cutout is positioned along the bottom edge between the front side and the rear side; and further comprising a third reinforcement panel that is affixed to the kimono jacket adjacent to the cutout.

8. The reinforced martial arts kimono of claim 1, wherein the material or the at least two anti-grip reinforcement panels is coated with polytetrafluoroethylene.

9. The reinforced martial arts kimono of claim 1, wherein the reinforced anti-grip martial arts kimono jacket includes a bottom edge; and further comprising a third reinforcement panel that is affixed to the reinforced anti-grip martial arts kimono jacket along the bottom edge.

10. The reinforced anti-grip martial arts kimono of claim 1, wherein the kimono jacket further includes a third anti-grip reinforcement panel being located on the inside surface of the kimono at the area surrounding the collar of the kimono jacket.

* * * * *